US006170698B1

(12) United States Patent
Phelps et al.

(10) Patent No.: US 6,170,698 B1
(45) Date of Patent: Jan. 9, 2001

(54) ADAPTER FOR DISPENSING STACKED INTERFOLDED SHEETS FROM A ROLLED PRODUCT DISPENSER

(75) Inventors: Stephen L. Phelps, Lilburn; Diane Scheurell, Alpharetta, both of GA (US)

(73) Assignee: Kimberly-Clark Worldwide, Inc., Neenah, WI (US)

( * ) Notice: Under 35 U.S.C. 154(b), the term of this patent shall be extended for 0 days.

(21) Appl. No.: 09/342,557

(22) Filed: Jun. 29, 1999

(51) Int. Cl.[7] ..... B65H 1/00

(52) U.S. Cl. ..... 221/45; 221/48; 221/61; 221/63; 221/199

(58) Field of Search ..... 221/199, 48, 47, 221/45, 33, 44, 46, 49, 61, 63, 64, 197, 282, 283, 287

(56) References Cited

U.S. PATENT DOCUMENTS 2,765,909 * 10/1956 Graham ..... 221/45 X 4,913,312 * 4/1990 Boutin ..... 221/45

* cited by examiner

*Primary Examiner*—David H Bollinger
(74) *Attorney, Agent, or Firm*—Dority & Manning

(57) ABSTRACT

An adapter is provided for dispensing stacked interfolded sheets from a rolled product dispenser. The adapter includes a body having a configuration so as to fit over an open front of a conventional rolled product dispenser. The body cooperates with the dispenser to define a receptacle space for stacked interfolded sheets, such as bathroom or facial sheets. A dispensing opening is defined through the front wall of the body. The opening may have a width dimension so that side edges of the stacked interfolded sheets are urged inwardly upon being pulled through the dispensing opening. A releasable attaching device is configured on the body whereby the body is removably attachable to the rolled product dispenser.

15 Claims, 5 Drawing Sheets

ADAPTER FOR DISPENSING STACKED INTERFOLDED SHEETS FROM A ROLLED PRODUCT DISPENSER

FIELD OF THE INVENTION

The present invention relates to an adapter for dispensing interfolded stacked sheets from a rolled product dispenser, and more particularly to an adapter for a conventional single roll product dispenser.

BACKGROUND OF THE INVENTION

A wide variety of dispensers are available for dispensing material such as tissues, paper towels, and the like. Most dispensers are configured to dispense these products either from a roll or from a stack of interfolded sheets. For example, dispensers for rolled products, such as rolls of bathroom tissue, are well known in the art. With such conventional single roll dispensers, the dispenser includes a housing for receipt of at least a portion of the roll. The roll is typically held between sides of the dispenser by way of a spindle that engages in recesses or slots in the dispenser sides. Such dispensers typically have an open front face, and the rolled product is dispensed by the consumer simply pulling the end sheets of the roll. These conventional single roll dispensers may be recessed within a wall or other supporting structure.

In selected applications, it is desired to use stacked interfolded sheets of material instead of the roll forms. The interfolded sheets are typically dispensed from a top or bottom hygienic dispenser in which essentially only the end of the interfolded sheet is exposed. The remaining sheets are covered, typically within the dispenser. Unfortunately, conventional rolled product dispensers are not configured to dispense stacked interfolded sheets. Thus, when a user desires to switch from dispensing a rolled product to dispensing interfolded sheets, a new dispenser must be purchased and installed. Additionally, in certain circumstances, it may be desired to alternate between dispensing rolled materials and dispensing stacked interfolded sheets. It would not be feasible to change out and re-install the respective dispensers in these circumstances.

Accordingly, an adapter is desirable which enables a user to easily and inexpensively adapt a rolled product dispenser to stacked interfolded sheet dispenser without damaging or permanently altering the rolled product dispenser. Such an adapter would allow for relatively quick and easy change out between the two types of product.

SUMMARY OF THE INVENTION

Objects and advantages of the invention will be set forth in part in the following description, or may be obvious from the description, or may be learned through practice of the invention.

The present invention is directed to an adapter particularly suited for dispensing stacked interfolded sheets from a rolled product dispenser. The adapter is configured to fit over an open front of a conventional rolled product dispenser. The particular type of conventional rolled product dispenser is not limited to the present invention. Generally, such rolled product dispensers define an internal space or volume for receipt of the rolled product, typically by way of a spindle inserted through the rolled product and engaged in sides of the dispenser. Such conventional dispensers may be mounted within recesses of a wall or other supporting structure.

The adapter according to the invention includes a body having a configuration so as to fit over the open front of the rolled product dispenser. In this way, the body cooperates with the dispenser to define a receptacle space for receipt of stacked interfolded sheets. In this regard, the body may comprise an outwardly projecting front wall or member defining an interior volume of the body. The interior volume of the body and the interior volume of the rolled product dispenser thus become the receptacle space for the interfolded stacked sheets.

A dispensing opening is defined through a front wall of the body. This opening can have any manner of shape or configuration and, desirably, may have a width dimension so that the side edges of the stacked interfolded sheets are urged inwardly upon being pulled through the dispensing opening. Any configuration of such an opening is within the scope of the invention.

A releasable attaching device is configured with the body so that the body may be removably attached to the rolled product dispenser or its respective wall or other supporting structure.

In one particular embodiment of the present invention, the body comprises side walls and a generally open back. The side walls and the front wall define the interior volume of the adapter. The front wall may have a curved cross-sectional profile that also forms a top and bottom surface of the body. In an alternative embodiment, a top and bottom surface may be defined by planar height extensions of the body. For purposes of attaching the body and providing stability to the body, it may be preferred that the body have a height and width dimension such that at least one of the height or width dimensions is greater than the respective height or width of the rolled product dispenser open front. In this manner, at least some portion of the dispenser body will abut against an outside surface or rim of the rolled product dispenser. For example, the body may include a top or bottom height extension that abuts against the top or bottom rim surfaces of the rolled product dispenser when the adapter is mounted thereto.

It may be preferred that the body also include alignment members that extend generally rearward relative to the front wall. The alignment members are disposed so as to fit within the rolled product dispenser and align the body relative thereto. The alignment members may take on any form or configuration. In one desirable embodiment, the alignment members comprise extensions of side walls of the body that extend rearwardly beyond an open back of the body. These extensions slide within the rolled product dispenser upon mounting the adapter onto the dispenser. In this embodiment, the releasable attaching device may comprise projections that extend outwardly from the side wall extensions of the body. These projections may have a size and configuration so as to fit within the existing spindle holes or recesses provided in the sides of the rolled product dispenser. The projections may be spring loaded or the side walls may have enough flexibility so as to be manually flexed inward to allow insertion of the projections into the spindle holes or recesses.

In an alternative embodiment, the body comprises an open back defined by a circumferential flange. This flange may define a back surface that generally circumscribes the rolled product dispenser open front. This back surface may include any type of adhesive material, such as an adhesive tape, configured thereon for mounting the adapter body to the dispenser. In this embodiment, the alignment members may comprise bosses that extend rearwardly passed the circumferential flange. The bosses slide within the rolled product dispenser upon mounting the adapter onto the dispenser and help to align the dispenser and maintain the stability thereof.

The invention will be described in greater detail below through use of the appended drawings.

DETAILED DESCRIPTION

Figure 1:
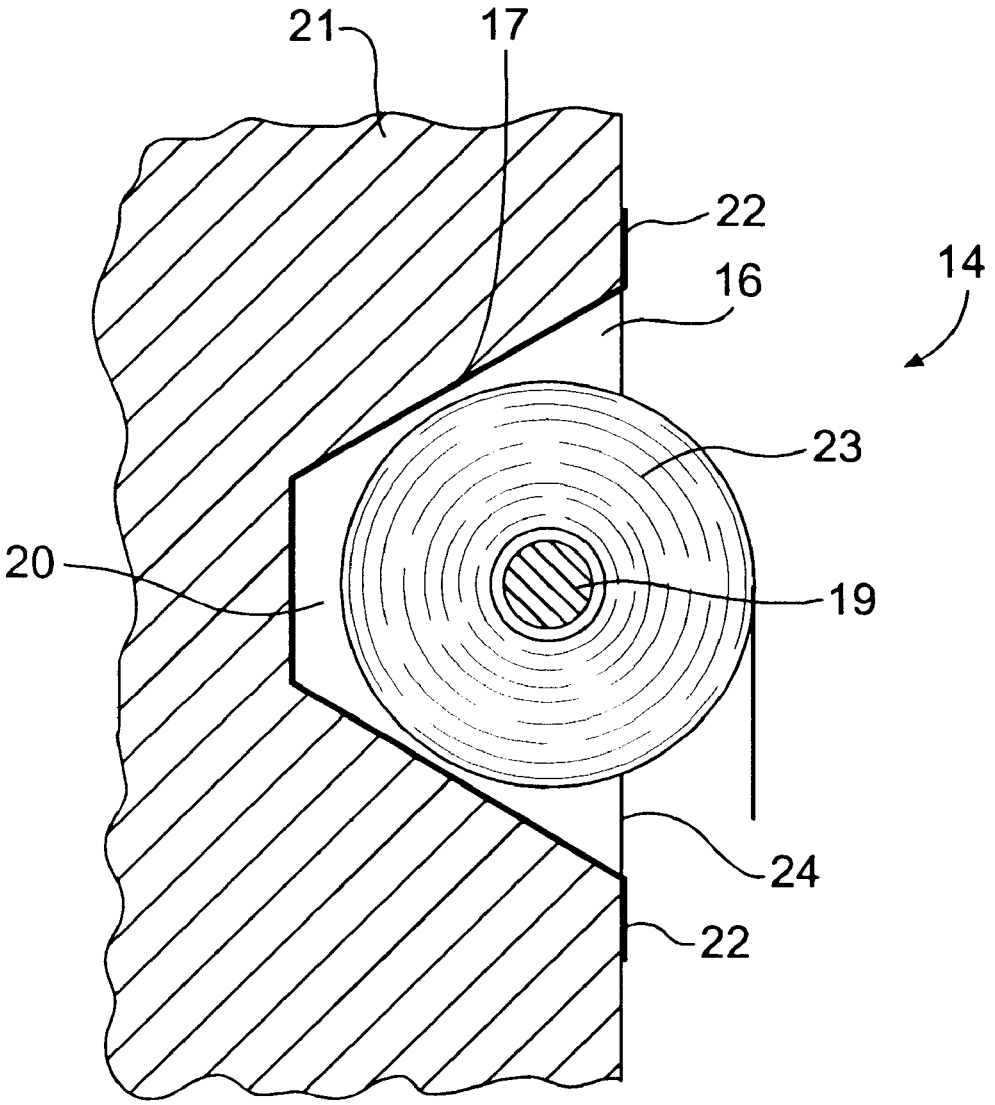
FIG. 1 PRIOR ART
FIG. 1 is a cross-sectional view of a conventional single roll dispenser.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present application include such modifications and variations.

FIG. 1 illustrates a simplified view of a conventional rolled product dispenser, generally 14. Dispenser 14 is but an example of any number of conventional rolled product dispensers to which the adapter of the present invention may be configured. Such conventional rolled product dispensers, and particularly dispensers for single rolls of bathroom tissue, are well known to those skilled in the art and a detailed explanation thereof is not necessary for purposes of the present description. Briefly, dispenser 14 is formed of a plastic or sheet metal, or other suitable material forming a body 17 with sides 16. The dispenser may be mounted on an outside of a wall or support structure 21, or may be recessed within wall 21, as particularly illustrated in FIG. 1. The present invention is applicable to any mounting configuration of dispenser 14.

The typical dispenser 14 usually defines an interior volume, generally 20, for receipt of a roll of bathroom tissue 23, or other rolled products. The roll is typically held by a spindle 19 in spindle recesses or holes (not shown) provided in sides 16 of dispenser 14. Dispenser 14 may include an outwardly facing flange or rim member 22, particularly if the dispenser 14 is in a recessed configuration as shown in FIG. 1. Dispenser 14 may also include any other outwardly facing structure or member. An open face 24 is typically defined by dispenser 14 wherein the rolled product 23 extends outwardly beyond face 24. In an alternative conventional configurations, a removable cover may also be provided with dispenser 14.

Although the present invention will be described as an embodiment particularly suited for configuration with conventional single roll bathroom tissue dispensers, it should be appreciated that such is not a limitation of the invention. The present adapter is applicable in any instance wherein it is desired to convert a single roll dispenser into a dispenser for interfolded sheets.

Figure 2:
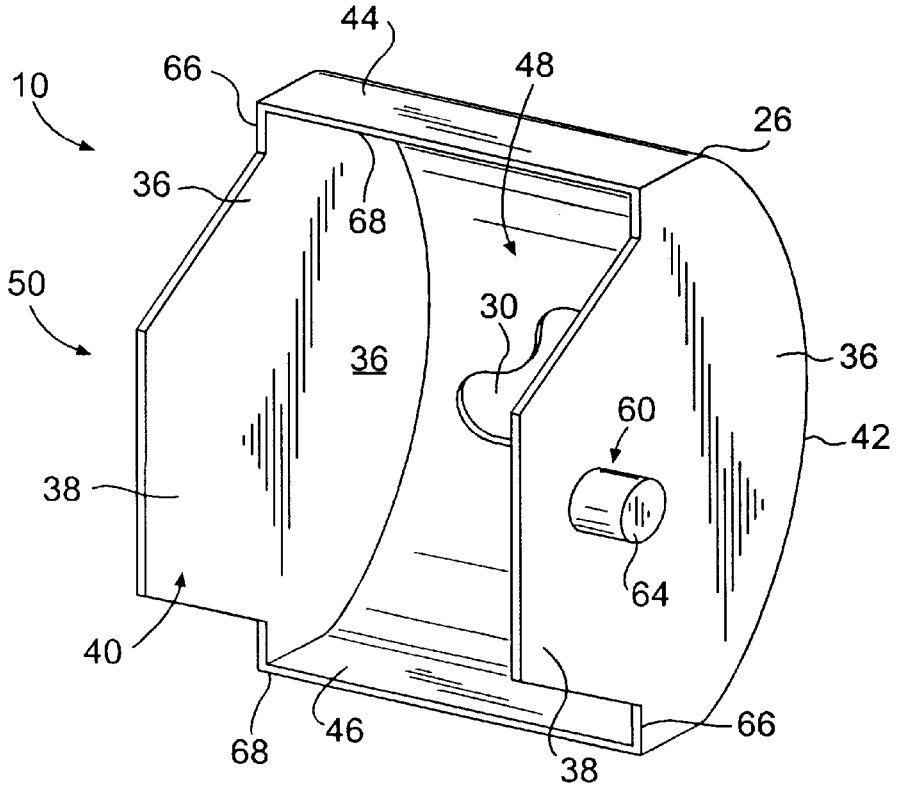
FIG. 2 is a perspective back view of an embodiment of the adapter according to the invention.
Figure 3:
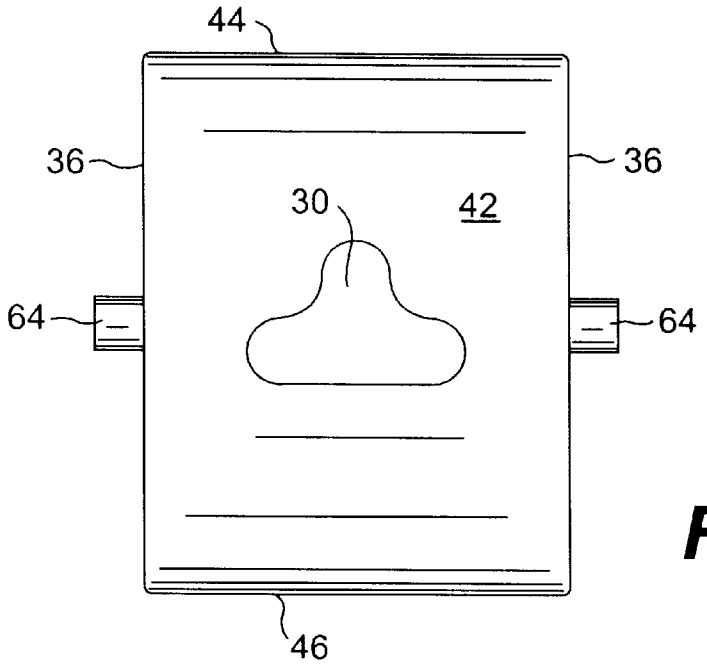
FIG. 3 is a front view of the adapter illustrated in FIG. 2.

FIGS. 2 and 3 illustrate one desirable embodiment of an adapter 10 particularly suited for configuration with conventional dispensers 14 to convert the dispenser into a dispenser for interfolded stacked sheets 12 (FIG. 4), such as conventional bathroom or facial tissue sheets.

Adapter 10 includes a body 26 that may take on any manner of configuration. Body 26 is formed so as to be matable with dispenser 14, for example by fitting over the front open face 24 of dispenser 14. Body 26 defines an interior volume or space 48 that, when combined with the interior volume or space 20 of dispenser 14, defines a receptacle space 28 for a stack of interfolded sheets 12, as particularly illustrated in FIGS. 4 and 7. Interior volume 48 of body 26 may be defined by any structure, for example the forwardly projecting front wall 42 illustrated in FIGS. 2 through 4.

Figure 4:
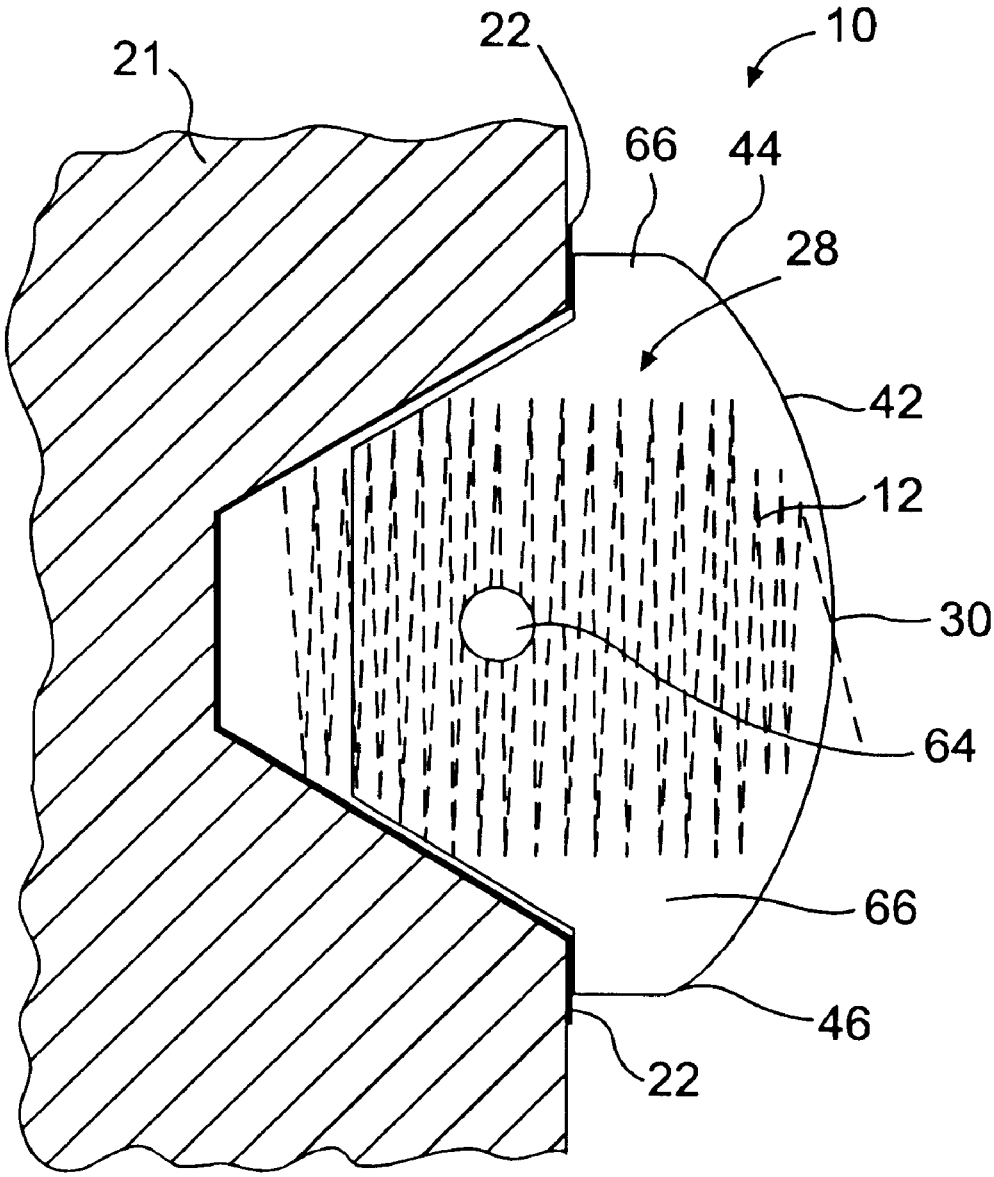
FIG. 4 is a cut-away side view of the adapter of FIGS. 2 and 3 shown in its mounted configuration with a conventional rolled product dispenser.

In the embodiment illustrated in FIGS. 2 through 4, body 26 is defined by a semi-circular front wall member 42 and side walls 36. A top wall 44 and bottom wall 46 are also provided as planar members. The curvature of front wall 42 may be continued through top wall 44 and bottom wall 46 as well.

Figure 7:
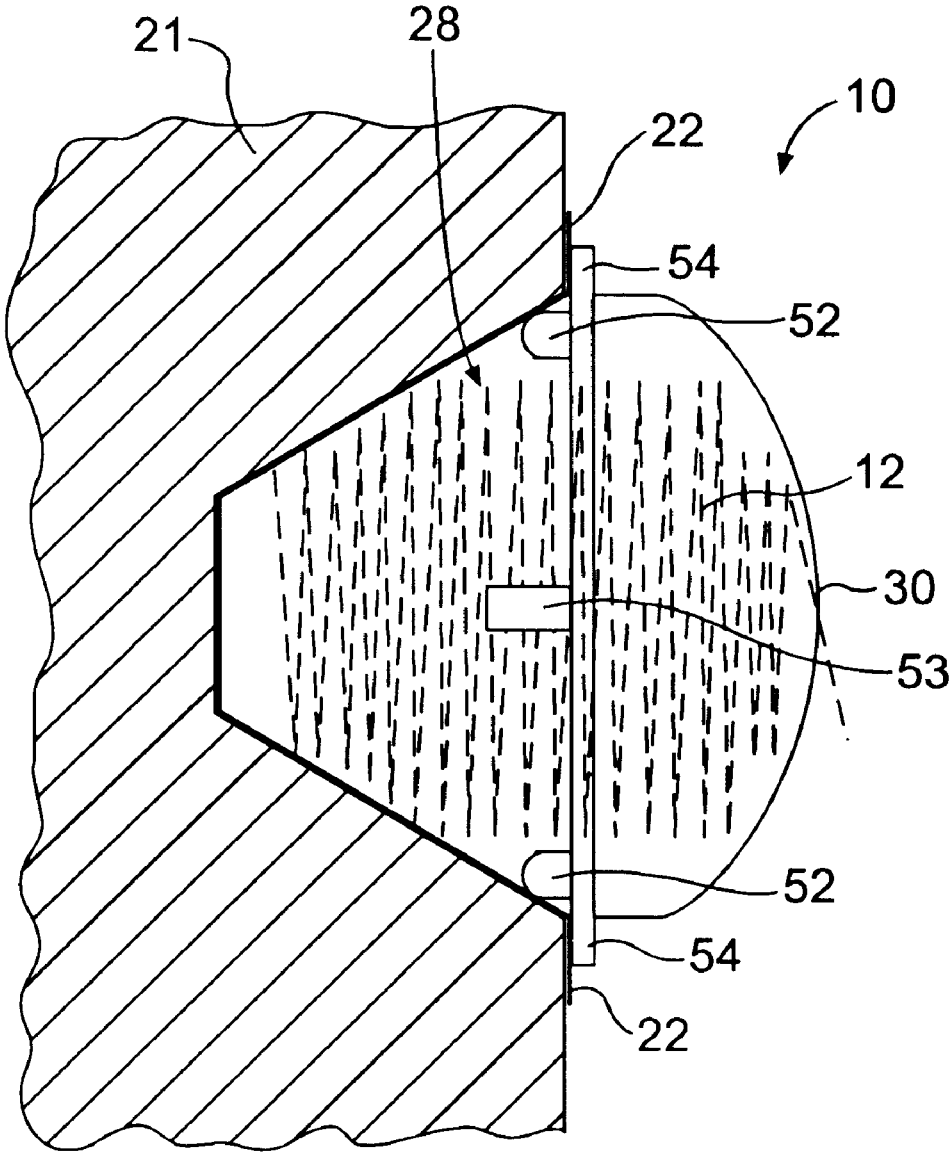
FIG. 7 is a cut-away view of the adapters illustrated in FIGS. 5 and 6 shown in its mounted configuration with the conventional rolled product dispenser.

A dispensing opening 30 is defined through front wall 42. In use, as illustrated in simplified form in FIG. 4, the leading sheet of the stacked interfolded sheets 12 extends through opening 30 and is grasped and pulled by the consumer. Opening 30 may have a width dimension so that the side edges of the stacked interfolded sheets are urged inwardly upon being pulled through opening 30. It should be appreciated that opening 30 can take on any manner of shape or configuration, such as a dumbbell shape, elongated shape, star-shape, keyhole-shape, etc. The configuration of opening 30 illustrated in the figures is for exemplary purposes only. Opening 30 may be disposed at any suitable location on front wall 42. It should also be appreciated that the arrangement of the interfolded sheets within the dispenser is not a limitation of the invention and the arrangement shown in FIGS. 4 and 7 is only an example. The sheets may be in a fan arrangement or vertically stacked arrangement, or any other suitable arrangement.

Adapter 10 also preferably includes a releasable attaching device configured on body 26 that allows body 26 to be easily attachable to and removable from dispenser 14. In the example illustrated in FIGS. 2 through 4, the releasable attaching device is illustrated generally as 60 and includes members 64 projecting outwardly from side walls 36. Projections 64 have a size and configuration so as to fit within the spindle holes or recesses defined in side walls 16 of dispenser 14. Projections 64 may be spring loaded or side walls 36 may be somewhat flexible so as to be manually flexed inward for body 26 to be inserted between side walls 16 of dispenser 14. Projections 64 move outwardly into the spindle holes or recesses upon being aligned therewith and walls 36 return to their former or non-flexed state.

Body 26 has an open back, generally 40, that must be aligned with the open front face 24 of dispenser 14. In this regard, body 26 preferably includes alignment members, generally 50. Alignment members 50 may extend rearwardly relative to front wall 42 and are located so as to fit within dispenser 14 and align body 26 relative thereto. In the embodiment illustrated in FIGS. 2 through 4, alignment members 50 are defined by wall extensions 38 of side walls 36. Extensions 38 generally slide against walls 16 of dispenser 14. Projections 64 are defined on the wall extensions 38. Extensions 38 may abut against side walls 16 in the mounted configuration of adapter 10 on dispenser 14, as illustrated in FIG. 4.

Referring to FIG. 4, height extensions 66 may also be defined by body 26. Height extensions 66 have a back edge 68 that abuts against the rim or other circumferential surface 22 of adapter 14. The height extensions could just as well abut against any portion of the wall or supporting structure 21. Thus, in this embodiment, a height dimension of body 26 is provided that is greater than the height of open face 24 of dispenser 14. This greater height dimension results in adapter 10 abutting against an outer surface or component of dispenser 14, thus providing stability to the mated configuration of the components. A greater width dimension of body 26 may also be provided for the same purpose.

Figure 5:
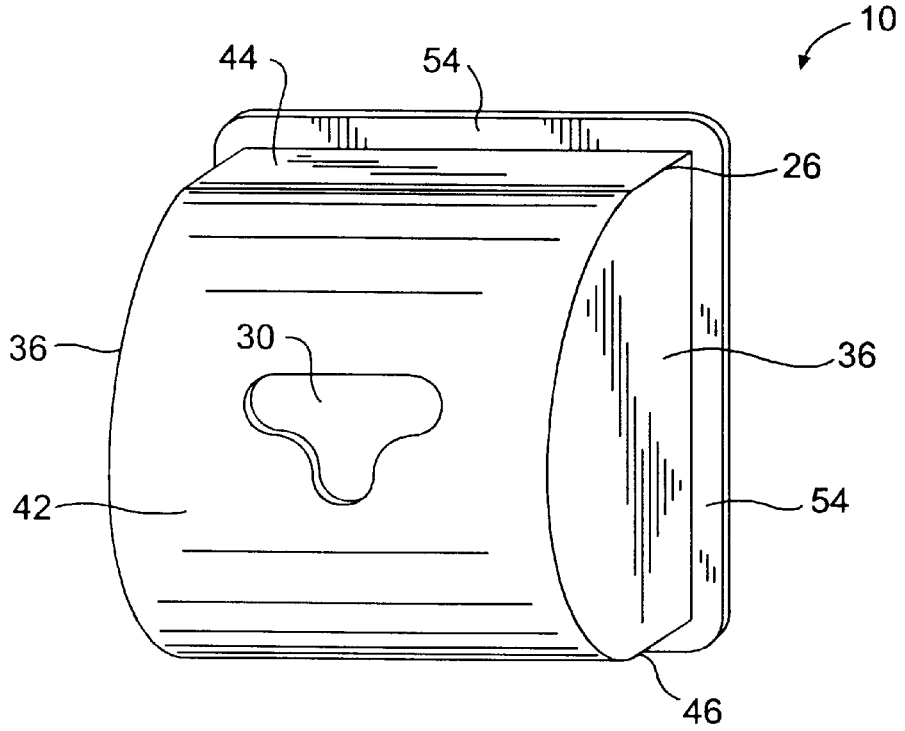
FIG. 5 is a front perspective view of an alternative preferred embodiment of the adapter according to the invention.
Figure 6:
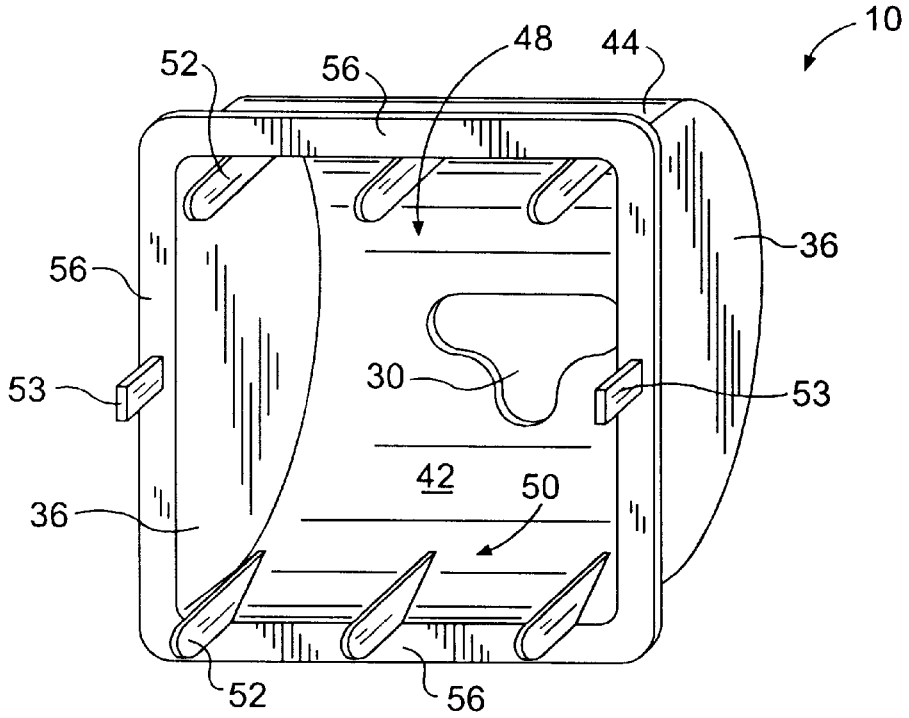
FIG. 6 is a back perspective view of the adapter illustrated in FIG. 5.

An alternative embodiment of adapter 10 is illustrated in FIGS. 5 through 7. Body 26 includes dispensing opening 30, front wall 42, side walls 36, and top and bottom walls 44, 46. In this embodiment, a flange member 54 defines the height and width of adapter 10. Flange 54 is configured so as to generally circumscribe open face 24 of dispenser 14, as illustrated at least partially in FIG. 7. Flange 54 includes a back surface 56 that may include any manner of adhesive material, such as an adhesive tape, that allows adapter 10 to be readily attached to and removed from rim surface 22 of dispenser 14, or any other structure associated with dispenser 14, including wall 21. In the embodiment of FIGS. 5 through 7, the alignment members 50 are defined by rearwardly extending bosses 52. Bosses 52 are disposed so as to generally abut against the internal structure of dispenser 14 to align and stabilize adapter 10 relative to dispenser 14. Side bosses 53 may be desired and particularly disposed so as to slide against sides 16 of dispenser 14 upon mounting adapter 10 therewith.

It should be appreciated that adapter 10 according to the invention may be constructed of a wide variety of materials, such as metals, plastics, or other materials. The construction of adapter 10 will depend on which materials are utilized. For example, a variety of plastics may be utilized to mold body 26 as a one-piece unitary housing.

It should be appreciated by those skilled in the art that various modifications and variations can be made in the present invention without departing from the scope and spirit of the invention. For example, dispensing opening 30 may take on any shape or configuration suitable for dispensing interfolded stacked sheets. Likewise, body 26 may take on any exterior shape, such as rectangular, and so forth. It should also be appreciated that any manner of releasable attaching mechanism or device may be utilized to mount adapter 10 to dispenser 14 without permanently altering or in any way damaging dispenser 14. In this manner, it is relatively simple for the user to attach adapter 10 and subsequently remove the adapter to reconfigure dispenser 14 as a conventional roll dispenser. It is intended that the present invention include such modifications and variations as come within the scope and spirit of the appended claims and their equivalents.

What is claimed is:

1. An adapter for dispensing stacked interfolded sheets from a rolled product dispenser, said adapter comprising:

a body having a configuration so as to fit over an open front of a rolled product dispenser, said body thereby cooperating with the dispenser to define a receptacle space for receipt of stacked interfolded sheets such that said stacked interfolded sheets are housed at least partially in said body and at least partially in said rolled product dispenser;

a dispensing opening defined through a front wall of said body; and a releasable attaching device configured on said body whereby said body is removably attachable to the rolled product dispenser.

2. An adapter for dispensing stacked interfolded sheets from a rolled product dispenser, said adapter comprising:

a body having a configuration so as to fit over an open front of a rolled product dispenser, said body thereby cooperating with the dispenser to define a receptacle space for receipt of stacked interfolded sheets;

a dispensing opening defined through a front wall of said body;

a releasable attaching device configured on said body whereby said body is removably attachable to the rolled product dispenser; and wherein said body comprises side walls, and a generally open back, said side walls and front walls defining an interior volume that defines at least a portion of said receptacle space.

3. The adapter as in claim 2, wherein said front wall has a curved cross-sectional profile and also forms a top and bottom surface of said body.

4. An adapter for dispensing stacked interfolded sheets from a rolled product dispenser, said adapter comprising;

a body having a configuration so as to fit over an open front of a rolled product dispenser, said body thereby cooperating with the dispenser to define a receptacle space for receipt of stacked interfolded sheets;

a dispensing opening defined through a front wall of said body;

a releasable attaching device configured on said body whereby said body is removably attachable to the rolled product dispenser; and wherein said body comprises alignment members extending rearwardly relative to said front wall, said alignment members disposed so as to fit within the rolled product dispenser and align said body relative thereto.

5. The adapter as in claim 4, wherein said body comprises side walls and a generally open back, said alignment members comprising extensions of said side walls that extend rearwardly beyond said open back and slide within the rolled product dispenser upon mounting said adapter onto the rolled product dispenser.

6. The adapter as in claim 5, wherein said releasable attaching device comprises a projection extending transversely from said side wall extensions, said projection having a size so as to fit within spindle holes or recesses provided in sides of the rolled product dispenser.

7. The adapter as in claim 4, wherein said body comprises an open back defined by a circumferential flange, said alignment members comprising a plurality of bosses extending rearwardly past said flange, said flange abutting against an outer surface of the rolled product dispenser and said bosses sliding within the rolled product dispenser upon mounting said adapter onto the rolled product dispenser.

8. The adapter as in claim 7, wherein said releasable attaching device comprises an adhesive material on said flange.

9. An adapter for dispensing stacked interfolded sheets from a rolled product dispenser, said adapter comprising:

a body having a configuration so as to fit over an open front of a rolled product dispenser, said body thereby cooperating with the dispenser to define a receptacle space for receipt of stacked interfolded sheets;

a dispensing opening defined through a front wall of said body;

a releasable attaching device configured on said body whereby said body is removably attachable to the rolled product dispenser; and wherein said body has a height and width dimension such that at least one of said height and width is greater than the respective height and width of the rolled product dispenser open front.

10. An adapter for dispensing stacked interfolded sheets from a rolled product dispenser, said adapter comprising:

a body having a configuration so as to fit over an open front of a rolled product dispenser, said body having a front wall, side walls, and a generally open back, said front wall and side walls defining an interior volume that cooperates with an interior volume of the rolled product dispenser to define a receptacle space for receipt of stacked interfolded sheets;

a dispensing opening defined through said front wall, said opening having a dimension so that side edges of the stacked interfolded sheets are urged inwardly upon being pulled through said dispensing opening;

said generally open back circumscribed by edges wherein at least one of said edges is disposed against a rim surface of the rolled product dispenser upon mounting said adapter thereto, said body further comprising at least one alignment member extending rearwardly from said open back so as to slide within the rolled product dispenser interior volume and align said body relative to the dispenser; and a releasable attaching device configured on said body whereby said body is removably attachable to the rolled product dispenser.

11. The adapter as in claim 10, wherein said side walls comprise extensions that extend rearwardly beyond said open back so as to slide against side walls of the rolled product dispenser upon mounting said adapter thereto, said releasable attaching device comprising projections extending transversely from said side wall extensions, said projections having a size so as to fit within spindle holes or recesses provided in the rolled product dispenser.

12. The adapter as in claim 11, wherein said body member comprises a height extension having a back edge that abuts against the rim surface of the rolled product dispenser.

13. The adapter as in claim 10, wherein said open back is defined by a circumferential flange, said flange having a back surface that abuts against the rim surface of the rolled product dispenser.

14. The adapter as in claim 13, wherein said releasable attaching device comprises an adhesive material disposed on said flange back surface.

15. The adapter as in claim 14, wherein said alignment member comprises at least one boss extending rearwardly beyond said flange.

* * * * *